US005934341A

United States Patent [19]

Thieme

[11] Patent Number: 5,934,341

[45] Date of Patent: Aug. 10, 1999

[54] TOOL FOR TYING A CABLE HARNESS

[75] Inventor: Hans-Dieter Thieme, Uetersen, Germany

[73] Assignee: Paul Hellermann GmbH, Pinneberg, Germany

[21] Appl. No.: 08/947,837

[22] Filed: Oct. 9, 1997

[30] Foreign Application Priority Data

Oct. 10, 1996 [DE] Germany ..... 296 17 653 U

[51] Int. Cl.[6] ..... B21F 9/02

[52] U.S. Cl. ..... 140/93 A; 140/123.6

[58] Field of Search ..... 140/93 A, 93.2, 140/119, 123.6

[56] References Cited

U.S. PATENT DOCUMENTS

| | | | |
|---|---|---|---|
| 3,891,012 | 6/1975 | Bakermans | 140/93 A |
| 5,167,265 | 12/1992 | Sakamoto | 140/93.2 |
| 5,417,253 | 5/1995 | Kurmis | 140/93.2 |

FOREIGN PATENT DOCUMENTS

| | | | |
|---|---|---|---|
| 0 428 116 A1 | 5/1991 | European Pat. Off. | B65B 13/02 |
| 89 13 511 | 4/1991 | Germany | B65B 27/10 |
| 40 35 968 C2 | 4/1994 | Germany | B65B 27/10 |
| 92 14 901.4 | 4/1994 | Germany | B65B 27/10 |

*Primary Examiner*—Lowell A. Larson
*Attorney, Agent, or Firm*—Alix, Yale & Ristas, LLP

[57] ABSTRACT

A tool for tying an article, in particular a cable harness, by means of a tape, which tool comprises a tool body (1), a push rod (10) guided therein, which pushes the tape (6) into a wrapping position around the article to be tied, and a drive device for the push rod (10). The drive device for the push rod comprises a carriage (15) that is guided on the tool body (1) and moved forwards and backwards by means of a crank (12, 13), and a pinion (20) that is rotatably mounted on the carriage (15), rolls on a running track (21) arranged parallel to the carriage guide (16, 17) and, on its opposite side, engages directly or by means of a larger gear wheel (19) that is connected in terms of rotation into the push rod (10) which, at least in the region of movement of the carriage (15), is guided parallel to the latter.

5 Claims, 1 Drawing Sheet

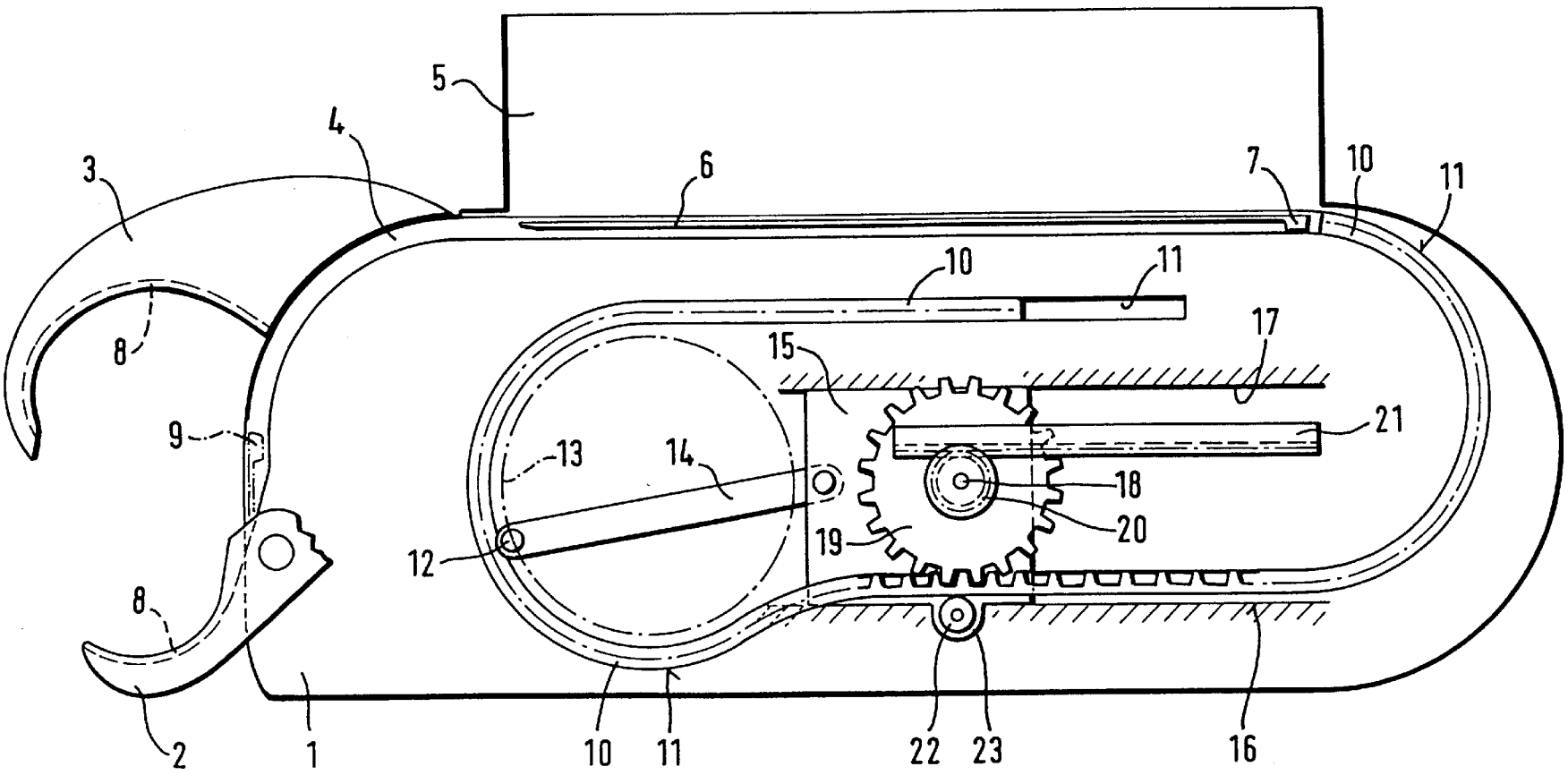
1
2
3
4
5
6
7
8
9
10
11
12
13
14
15
16
17
18
19
20
21
22
23

TOOL FOR TYING A CABLE HARNESS

FIELD OF INVENTION

The invention relates to a tool for tying an article, in particular a cable harness, by means of a tape. The tool comprises a tool body, a push rod guided therein, which pushes the tape into a wrapping position around the article to be tied, and a drive device for the push rod.

BACKGROUND OF THE INVENTION

In known cable-tying tools, a series of movements has to be carried out in a controlled sequence during an operating cycle, most of which movements are over a short path, so that they can be derived, for example, from one rotation of one or more cam discs. This includes the closing of the tongs, into which the tape is guided in order to wrap around the article to be tied; the insertion of the free end of the tape into the closure located at the rear end of the tape; the cutting off of the projecting end of the tape; the opening of the wrapping tongs (EP-A 428 116). In contrast to this, the pushing forward of the tape, with simultaneous wrapping around the tool, is a long-stroke operation which cannot easily be derived from a partial circumference of a cam disc. Known tools (DE-C 40 35 968, DE-U 92 14 901, DE-U 89 13 511) therefore use a separate drive for this, which is complicated.

SUMMARY OF THE INVENTION

The invention is based on the object of providing a tool of the type mentioned at the beginning in which even the tape advance is derived from that single shaft rotation per cycle on which the control of the remaining movement operations is based. The solution according to the invention consists in the features set forth herein.

According to the invention, a special drive is provided which is able to convert a rotation of a crank into a translation movement whose length is significantly greater than the crank diameter. This is required since the crank diameter is limited by the fact that the tool is intended to have the lowest possible transverse dimensions, whereas the translation movement is large, specifically must have at least the dimension of the tape length used. The crank may be connected in terms of rotation to the cam disc mentioned (or whatever else is otherwise provided to drive the other tool functions). It may be seated on the same shaft, but this is not necessary; it does not even need to have the same direction of rotation. What is decisive is that—just like the cam disc—it makes one revolution per operating cycle.

The movement of the crank is transferred to a carriage that is movable along an extended guide. This is expediently performed by means of a connecting rod. However, the crank may also engage directly on the carriage, by for example interacting with a sliding groove provided in the carriage transverse to its direction of motion. The carriage carries at least one small gear wheel, which is referred to here as a pinion, and which rolls on a running track which is provided parallel with the carriage guide. By this means, it is set rotating during the movement of the carriage. Its peripheral speed at its side facing away from the running track is twice as large, in relation to the tool body, as that of the carriage. If it interacts there directly with the push rod, the latter is therefore imparted an advance speed which is twice as large as that of the carriage, and a movement travel which is accordingly twice as large. However, preference is given to a design in which the pinion does not interact directly with the push rod but via a further, larger gear wheel, which is arranged coaxially with the pinion and is connected firmly to it in terms of rotation, and whose peripheral speed with respect to the running track is higher, in accordance with the diameter ratio, with the result that the advance speed and advance travel of the push rod is also correspondingly enlarged.

The gear wheels, the running track and the push rod are preferably of toothed construction; however design in the shape of a frictional drive or the like is not intended to be excluded from protection.

In order to ensure the engagement of the pinion or of the gear wheel in the push rod, according to the invention a counter bearing is provided, on which the push rod is supported against the engagement of the gear, this counter bearing expediently being provided on the carriage and being constructed as a roller in order to reduce the friction.

A rectilinearly extended design of the push rod is possible, but such a design would presuppose that the tool body, which accommodates the tape and the push rod one behind the other, is at least twice as long as the tape. A flexible design of the push rod, which is guided through a 180° deflection, is therefore more expedient, as is known per se (DE-C 40 35 968).

BRIEF DESCRIPTION OF THE DRAWING

The invention is explained in more detail below with reference to the drawing, which illustrates an exemplary embodiment schematically in a side view.

DETAILED DESCRIPTION OF A PREFERRED EMBODIMENT

The extended tool body 1 carries at its front end two tongs parts 2, 3, which can be moved in such a way that the tongs can be opened in order to accommodate a cable bundle and subsequently closed. Arranged in the tool body is a tape channel 4, which is connected to a tape magazine in such a way that at the beginning of an operating cycle a tape 6 to be processed is let out of said magazine into the tape channel 4. The tape 6 has an elongated tongue pointing towards the front side of the tool body, and a tape closure 7 at the rear end. The tape channel 4, which runs in a curve in the front region of the tool body, adjoins a guide groove 8 formed in the tongs parts when the tongs 2, 3 are closed. At the beginning of a tying operation, firstly the tongs 2, 3 are closed around the article to be tied, for example a cable bundle. In the process, the tape 6 in the tape channel and in the guide groove 8 is pushed forward until its closure 7 approximately reaches the position 9 illustrated by a chain-dotted line. The free end of the tape is then guided through the closure and tensioned. Finally, its projecting part is cut off. After the tongs 2, 3 have been opened, the tied article is released therefrom. The method in which these operations proceed in detail needs no explanation here, since it is known.

The advancing of the tape 6 in the tape channel 4 is performed by means of a flexible push rod 10, which is guided in a push-rod guide channel 11 such that it can move in its longitudinal direction. The push-rod guide channel 11 adjoins the tape channel 4. When the push rod 10 is pushed forward, it enters into the tape channel 4 and pushes the tape forward as far as the position 9.

The drive of the push rod is derived from a crank which is symbolized by a crank pin 12 and a chain-dotted circle 13, through which the crank pin 12 runs once during one operating cycle. Via a connecting rod 14, the crank drives a carriage 15 which is guided rectilinearly by a guide, which is indicated in the drawing by guide surfaces 16, 17 with hatching on the rear side, the said guide surfaces interacting with the side surfaces of the carriage 15. It goes without saying that the practical implementation can be configured in another way. From the point of view of frictional forces, it may be more expedient, for example, to provide on the carriage rollers that run in a guide groove.

Provided on the carriage 15 is a bearing for the common shaft 18 of a gear wheel 19 and a pinion 20, the latter being indicated in the drawing only by its circumferential lines and its pitch circle. The two wheels are connected to each other firmly in terms of rotation. The toothed circumference of the pinion 20 meshes with a rack 21 that is arranged in the tool body, in a fixed manner and parallel to the guide 16, 17. When the carriage 15 is moved along the guide 16, 17 by the crank 12, 13, the result is that the pinion 20 is driven in rotation and with it the gear wheel 19. The latter meshes, on the side opposite to the rack 21, with the push rod 10, which is designed as a rack. The said push rod is supported, in the region of engagement of the gear wheel 19, by a roller 22 which is mounted on a protrusion 23 connected to the carriage 15.

The crank 12, 13 can also be used for driving or controlling other operations. Thus, in its region of movement running transversely to the longitudinal direction of the tool body, it is suitable for moving forward a revolving drum that is provided in or on the magazine 5 and transfers the tapes into the tape guide channel 4.

The advance travel of the push rod 10 is composed of the movement travel of the carriage 15, which is equal to the diameter of the crank 12, 13, and the advance travel which is imparted to it by the gear wheel 19. This is greater than the carriage movement travel by the diameter ratio of the two gear wheels times two. An advance travel that is four to eight times greater than the crank diameter can easily be implemented using this principle.

I claim:

1. Tool for tying an article, in particular a cable harness, by means of a tape, which tool comprises a tool body, a push rod which pushes the tape into a wrapping position around the article to be tied, a push rod guide for guiding the rod while it pushes the tape and a drive device for driving the push rod along the guide, characterized in that the drive device for the push rod comprises a carriage that is guided on the tool body for movement forwards and backwards relative to the tool body and a large gear wheel rotatably mounted on the carriage in driving engagement with the push rod, the rod guide having a region of engagement between the rod and the gear wheel extending in a first direction generally parallel to the movement of the carriage and a driving region for pushing engagement between the rod and the tape extending in a direction opposite the first direction, the rod being flexible for movement between the driving region and the engagement region.

2. Tool according to claim 1, characterized in that the guide of the push rod (10) in the region of engagement between the drive rod and the gear wheel (19) includes a counter bearing (22) that is connected to the carriage (15) and supports the push rod on the side of the latter facing away from the region of engagement.

3. Tool according to claim 2, characterized in that the counter bearing is formed by at least one roller (22).

4. The tool of claim 1 wherein the tool body includes an elongated carriage guide and a running track arranged parallel to the carriage guide and the drive device includes a pinion rotatably mounted on the carriage for movement along the running track.

5. The tool of claim 4 wherein the pinion operatively cooperates with the gear wheel during forward and backward movement of the carriage.

* * * * *